US005968599A

United States Patent [19]

Jung et al.

[11] Patent Number: 5,968,599

[45] Date of Patent: Oct. 19, 1999

[54] TREATING METHOD FOR IMPARTING WATER-AND OIL-REPELLENT, SOIL-RELEASING AND ANTIBACTERIAL PROPERTIES TO POLYESTER/RAYON MIXED OR BLENDED FABRIC

[75] Inventors: Un Du Jung, Kyungsan; Jae Dong Chang; Je Hwan Lee, both of Taegu, all of Rep. of Korea

[73] Assignee: Saehan Industries Inc., Kyungsan, Rep. of Korea

[21] Appl. No.: 09/134,891

[22] Filed: Aug. 17, 1998

[30] Foreign Application Priority Data

Sep. 2, 1997 [KR] Rep. of Korea ..... 97-45515

[51] Int. Cl.[6] ..... D06M 10/04; D06M 15/19

[52] U.S. Cl. ..... 427/393.4; 252/8.61; 252/8.62; 427/389.9; 427/430.1

[58] Field of Search ..... 252/8.62, 8.61; 427/393.4, 430.1, 389.9

[56] References Cited

U.S. PATENT DOCUMENTS 4,814,206 3/1989 Hwang ..... 427/393.4

FOREIGN PATENT DOCUMENTS 54-38951 3/1979 Japan .

1-44837 9/1989 Japan .

3-35432 5/1991 Japan .

4-55491 2/1992 Japan .

OTHER PUBLICATIONS

Chemical Abstract No. 128:258407, abstract of Japanese Patent Specification No. 10–077579, Mar. 1998.

*Primary Examiner*—Anthony Green

*Attorney, Agent, or Firm*—Nikaido Marmelstein Murray & Oram, LLP

[57] ABSTRACT

A method for imparting the multiple functions of water- and oil-repellency, soil-releasing properties and anti-bacterial properties to a mixed or blended fabric is provided including: (a) treating a mixed or blended fabric of polyester/rayon by dipping the mixed or blended fabric in a treating solution which includes, based on the weight of the mixed or blended fabric, 1 to 10 wt. % of phenolic antibacterial agent, 2.5 to 5.0 wt. % of a first fluoric compound, 3.0 to 6.0 wt. % of a second fluoric compound, different from the first fluoric compound, 0.3 to 0.5 wt. % of melamine resin as a cross-linking agent and a buffer, the rate of absorption of treating solution by the mixed or blended fabric being maintained at 50±5%, (b) drying the treated fabric, and (c) thereafter heat treating the treated and dried fabric.

6 Claims, No Drawings

TREATING METHOD FOR IMPARTING WATER-AND OIL-REPELLENT, SOIL-RELEASING AND ANTIBACTERIAL PROPERTIES TO POLYESTER/RAYON MIXED OR BLENDED FABRIC

TECHNICAL FIELD

The present invention relates to a method for treating a textile fabric in a manner of imparting water-repellent, oil-repellent and soil-releasing properties as well as an antibacterial property to a mixed or blended fabric of polyester/rayon, and particularly to providing a method of imparting multiple properties to a fabric, wherein a phenol-based antibacterial agent is used and wherein a water-repellent or oil-repellent property is exhibited in the atmosphere or a soil-releasing property is exhibited in water due to a balanced coexistence of hydrophilicity and hydrophobicity, which are caused by the excited state of fluoric compounds in a controlled pH.

BACKGROUND ART

Generally, in a mixed or blended fabric of natural and synthetic fibers, there is often posed a problem that, when such a fabric is used for clothes, as a result of different fibrous characteristics of constituting fibers, microbes are incubated under the influence of sweat from human body and external pollutants, and a considerable quantity of ammonia is evolved to release an unpleasant odor or to inflict harm to the human body. Therefore there have been many attempts to impart an antibacterial function, as well as soil-releasing and water-repellent functions to fibrous materials.

However, the conventional art was restricted to a single function and thus, individual treating methods, for example, to impart the water-repellent and oil-repellent function, soil-releasing function or antibacterial and odor removing function were sought.

As a method to impart an antibacterial property to fibers, organic compounds based on silicon tertiary-ammonium are widely used in recent years, as disclosed in Japanese unexamined patent publication Sho 54-38951, wherein an ion exchange copolymer is produced and the product is treated with an aqueous solution of a copper or silver salt to deposit a metal ion on the surface of fibers whereby an antibacterial property is provided.

Further, in order to conduct a soil-releasing process on fabric cloth, there is disclosed a method in Japanese unexamined patent publication Hei 4-55491, wherein a silicon type agent for rendering soil-releasing function, incorporating a modified silicon compound, is coated on the fiber surface and another method in Japanese patent publication Hei 1-44837, wherein a film comprising a fluorine-containing compound and cationic surface active agent is coated on the fiber surface.

Still more, Japanese patent publication Hei 3-35432 discloses a water- and oil-repellency treating method for fabric cloth wherein dipping with a treating solution including a blocked polyisocyanate compound and a water-and oil-repellent agent based on silicon is conducted before drying and subsequently thermal treating is conducted.

The object of the present invention is to provide a multifunctional treating method wherein in order to bring forth multiple functions of water-repelling, oil-repelling, soil-releasing and bacteria resistance, a fluoric compound, a phenolic antibacterial agent and a buffer are minutely controlled through an adjustment of pH to create an excited state of a fluoric compound and a balanced coexistence of hydrophilicity and hydrophobicity whereby water-repellent and oil-repellent properties in the atmosphere and an antipolluting property in water are simultaneously exhibited, whereas the prior art failed to reveal the multiple functions because water-repelling and oil-repelling functions and a soil-releasing function were not in harmony, only a certain function being focussed on, which leads to a marked decrease in other functions.

SUMMARY OF THE INVENTION

In the present invention, pentachlorophenol(P.C.P) used as an antibacterial agent is added at an amount of 1 to 10% based on the weight of the cloth to be finished and more preferably at 2 to 3%. At less than 1%, the antibacterial durability decreases so badly that the antibacterial effect drops abruptly at the time of laundering and at more than 10%, on the other hand, process pass is hardly expected besides the economic disadvantage.

The fluoric compounds used for the invention may comprise the combination of perfluoro alkyl acrylate copolymer as the fluoric compound(I) and fluoro aliphatic ester copolymer as the fluoric compound(II), and the added amount for the fluoric compound(I) is suitably 2.5 to 5.0% based on the weight of the cloth and most preferably 3.0 to 3.2%, while the suitable amount is 3.0 to 6.0% and the most preferable amount is 3.2 to 3.5% for the case of the fluoric compound (II).

In case either the added amount of the fluoric compound (I) is less than 2.5%, or that of the fluoric compound(II) is more than 6.0%, the water repellency after the laundering falls to 80% as compared to 100% before the laundering, the oil repellency after the laundering deteriorates to under class 5 as compared to class 5 before the laundering and the soil-releasing ability also deteriorates to class 2 or under after the laundering from class 3 before the laundering, showing the decrease in durability.

Similarly, in case either the added amount of the fluoric compound(I) is more than 5.0%, or that of the fluoric compound(II) is less than 3.0%, the water repellency after the laundering falls to 50% as compared to 80% before the laundering, the oil repellency after the laundering deteriorates to class 3 or under from class 5 before the laundering and the soil-releasing ability deteriorates to class 5 or under after the laundering from class 7 before the laundering, whereby satisfaction in water or oil repellency and the soil-releasing property is hardly expected.

In the present invention, melamine resin is used as a cross-linking agent and particularly it is added at an amount of 0.3 to 0.5% based on the cloth to be teated. The treating solution which also includes the above mentioned cross-linking agent is diluted with acetic acid as a buffer to move pH into the range of 5 to 6, the fabric is dipped in that treating solution so that the pick-up of 50±5% is maintained, and then the wetted fabric is dried at 130 to 150° C. in an oven before it is thermally set at 170 to 180° C., to thereby realize an excellent water- and oil-repellent effect and soil-releasing effect as well as an excellent antibacterial effect thanks to the balance of hydrophilicity and hydrophobicity. At that time, if the addition amount of the cross-linking agent is either under 0.3% or over 0.5%, the activation and cross-linking effects of the fluoric compounds(I) and (II) are markedly lowered to result in deteriorated durability.

Some working examples of the present invention will now be described.

EXAMPLE 1

In a treating solution in which 2.5 wt % of pentachlorophenol, 3.0 wt % of perfluoro alkyl acrylate copolymer as the fluoric compound(I), 3.2 wt % of fluoro aliphatic ester copolymer as the fluoric compound(II) and 0.3 wt % of melamine resin were added and which was then diluted with acetic acid to adjust pH at around 5 to 6, there was dipped a mixed fabric of polyester/rayon, which was dyed in an ordinary manner, and the pick-up was maintained at 50%. Then, the treated fabric was removed from the treating bath, dewatered, placed in an oven at 140° C. for drying and thereafter thermal setting was conducted at 180° C. The results of evaluation for the water- and oil-repellency, the soil-releasing property and the antibacterial durability of the fabric cloth which was treated as above are listed in Table 1.

EXAMPLE 2

In a treating solution in which 3.0 wt % of pentachlorophenol, 3.2 wt % of perfluoro alkyl acrylate copolymer as the fluoric compound(I), 3.5 wt % of fluoro aliphatic ester copolymer as the fluoric compound(II) and 0.5 wt % of melamine resin were added and which was then diluted with acetic acid to adjust pH at 5 to 6, there was dipped a blended fabric of polyester/rayon, and the pick-up rate was maintained at 55%. Then, the treated fabric was removed from the treating bath, dewatered, dried in an oven at 130° C. and thereafter thermal setting was conducted at 170° C. The results of evaluation for the water- and oil-repellency, the soil-releasing property and the antibacterial durability of the fabric cloth which was treated as above are listed in Table 1.

COMPARATIVE EXAMPLE 1

In a treating solution in which 0.5 wt % of P.C.P, a phenolic antibacterial agent, 3.0 wt % of perfluoro alkyl acrylate copolymer as the fluoric compound(I), and 0.2 wt % of melamine resin were added and which was then diluted with acetic acid, there was dipped a mixed fabric of polyester/rayon, and the pick-up rate was maintained at 60%. Then, the treated fabric was dried and thereafter thermal setting was conducted at 180° C. The results are listed in Table 1.

COMPARATIVE EXAMPLE 2

In a treating solution in which 0.5 wt % of P.C.P, a phenolic antibacterial agent, 7.0 wt % of perfluoro alkyl acrylate copolymer as the fluoric compound(I), 7.0 wt % of fluoro aliphatic ester copolymer as the fluoric compound(II) were added and which was then diluted with acetic acid, there was dipped a mixed fabric of polyester/rayon, and the pick-up rate was maintained at 70%. Then, the treated fabric was dried and thereafter thermal setting was conducted at 170° C. The results are listed in Table 1.

TABLE 1

| Items for evalu. | | Division | | | |
|---|---|---|---|---|---|
| | | Examp1e 1 | Example 2 | Comp. Ex. 1 | Comp. Ex. 2 |
| Water-repellence | before laundering | 100% | 100% | 100% | 80% |
| | after (5th) laundering | 80% | 85% | 70% | 50% |
| Oil-repellence | before laundering | Class 5 | Class 5 | Class 5 | Class 5 |
| | after (5th) laundering | Class 5 | Class 5 | Class 3 | Class 4 |
| Soil-releasability | before laundering | Class 7 | Class 7 | Class 7 | Class 3 |
| | after (5th) laundering | Class 7 | Class 7 | Class 5 | Class 2 |
| Antibacterial durability | before laundering | 99.9% | 99% | 70% | 70% |
| | after (l0th) laundering | 99% | 97% | 50% | 45% |

The present invention resides in a useful method for treating fabrics, wherein the fabrics are treated with a treating solution, which comprises basically pentachlorophenol(P.C.P) as a phenolic antibacterial agent, perfluoro alkyl acrylate copolymer as fluoric compound(I) and fluoro aliphatic ester copolymer as fluoric compound (II), both fluoric compounds being fluorine-containing polymers each having perfluoro alkyl group as side chain, and melamine resin as cross-linking agent, and which is diluted with acetic acid, and are then dried and heat treated so that the fiber may be in balance with regard to hydrophilicity and hydrophobicity, whereby the fabrics are provided with muliple functions such as water- and oil-repellency, soil-releasability and antibacterial activity.

What is claimed is:

1. A method for imparting the multiple functions of water- and oil-repellency, soil-releasing properties and antibacterial properties to a mixed or blended fabric comprising:

(a) treating a mixed or blended fabric of polyester/rayon by dipping said mixed or blended fabric in a treating solution which includes, based on the weight of the mixed or blended fabric, 1 to 10 wt. % of phenolic antibacterial agent, 2.5 to 5.0 wt. % of a first fluoric compound, 3.0 to 6.0 wt. % of a second fluoric compound, different from the first fluoric compound. 0.3 to 0.5 wt. % of melamine resin as a cross-linking agent and a buffer, the rate of absorption of treating solution by the mixed or blended fabric being maintained at 50±5%, (b) drying the treated fabric, and (c) thereafter heat treating the treated and dried fabric.

2. The method according to claim 1, wherein said phenolic antibacterial agent is pentachlorophenol.

3. The method according to claim 1, wherein said first fluoric compound is a perfluro alkyl acrylate copolymer which is a fluoric compound having a perfluoro alkyl group as side chain.

4. The method according to claim 1, wherein said second fluoric compound is a fluoro aliphatic ester copolymer.

5. The method according to claim 1, wherein said the buffer is acetic acid.

6. A method for imparting the multiple functions of water- and oil-repellency, soil-releasing properties and antibacterial properties to a mixed or blended fabric, comprising:

(a) treating a mixed or blended fabric of polyester/rayon by dipping said mixed or blended fabric in a treating solution which includes, based on the weight of the mixed or blended fabric, 1 to 10 wt. % of pentachlorophenol, 2.5 to 5.0 wt. % of perfluoralkyl acrylate copolymer, 3.0 to 6.0 wt. % of a fluoroaliphatic ester copolymer, 0.3 to 0.5 wt. % of melamine resin, and a buffer, the rate of absorption of treating solution by said mixed or blended fabric being maintained at50±5%, (b) drying the treated fabric, and (c) thereafter heat treating the treated and dried fabric.

* * * * *